United States Patent [19]

Gill

[11] Patent Number: 4,922,943

[45] Date of Patent: May 8, 1990

[54] WATER CONSERVATOR SYSTEM AND METHOD

[76] Inventor: M. R. Gill, 5024 Glentara Dr., Midlothian, Va. 23112

[21] Appl. No.: 395,656

[22] Filed: Aug. 18, 1989

[51] Int. Cl.[5] ..... F17D 1/08

[52] U.S. Cl. ..... 137/1; 137/563; 137/209

[58] Field of Search ..... 137/206, 209, 211, 1, 137/563; 4/191

[56] References Cited

U.S. PATENT DOCUMENTS

| | | | |
|---|---|---|---|
| 763,051 | 6/1904 | Elliott | 137/211 |
| 2,318,066 | 5/1943 | Dodd | 137/209 X |
| 2,401,124 | 5/1946 | Walker et al. | 226/119 |
| 2,503,376 | 4/1950 | Burgess | 137/565 X |
| 3,779,278 | 3/1974 | Hill | 137/597 |
| 3,870,228 | 3/1975 | Moseley | 137/563 X |
| 4,077,545 | 3/1978 | Karls | 222/144.5 |
| 4,181,987 | 1/1980 | Kesselman | 4/191 |
| 4,290,152 | 9/1981 | Kesselman, Sr. | 4/191 |
| 4,605,200 | 8/1986 | Huppee | 251/258 |
| 4,774,978 | 10/1988 | Lepine, Jr. et al. | 137/334 |

*Primary Examiner*—Alan Cohan

[57] ABSTRACT

A water conserving system for plumbing installations in buildings, for instance in homes, institutions, industry, etc., facilitates saving of water during adjustment of volume and temperature and precludes the need for water shut-off and subsequent readjustment to accomodate suspensions of actual water use while saving, for reuse, the water that otherwise flows unused to drain and into the sewer system. The water conserving system provides water outlet fixtures having diverter valving means for selective diversion of water through return conduits to storage means, whence it is returned to the water supply for reuse, so that water adjustment may be performed with least water waste and water flow may be left turned on (and adjusted) without it being wasted to drain when actual use is temporarily suspended.

18 Claims, 9 Drawing Sheets

WATER CONSERVATOR SYSTEM AND METHOD

1. Field of the Invention

This invention relates to water conserving systems and methods in plumbing installations in buildings, for instance in homes, institutions, industry, etc.

2. Prior Art and Other Considerations

It is well known that clean water is in short supply and that this situation is becoming increasingly serious and even catastrophic in some areas. Consumption of clean water has conventionally been and is excessively wasteful, as large proportions of water used are dumped to drain without serving any useful purpose per se. In view of the water shortage that has reached acute proportions in many areas, a need for conservation of clean water and for reduction of water waste have become increasingly important in the management of this problem. Unfortunately, most customary plumbing installations provide little, if any, capabilities to assist users in water conservation.

Relatively large amounts of water are wasted while flow rate or volume and temperature are adjusted at various fixtures to suit personal preference and comfort. Additionally, many personal uses involve shorter or longer time periods when water is left running to drain between periods of actual use. For instance, water is left running during intermediate tasks, such as for example during soaping and shampooing in sinks, washbasins, and showers, and during brushing of teeth; one of the reasons being that subsequent rinsing and other use requires the previously adjusted flow and temperature. Readjustment of water flow and temperature, had water been turned off during the intermediate tasks, is inconvenient and time consuming and, in any case, does not necessarily save water, since any water saving may be offset by the water used during the readjustment.

It has been recognized, in prior art, that adjustment of water volume and temperature is wasteful and various solutions are taught to reduce such waste. For instance, U.S. Pat. No. 4,181,987 to Kesselman, U.S. Pat. No. 4,290,152 to Kesselman, Sr., and U.S. Pat. No. 4,605,200 to Huppee disclose water saving uses of various valve arrangements disposed at faucet fixture outlets, whereby water with preadjusted volume and temperature is turned on and off without a need for repeat adjustment. One difficulty with such arrangements is in that water temperature (and sometimes volume) cannot be kept constant, unless the adjusted flow to a fixture is sustained. Also, of course, water is wasted during adjustment, particularly during the time after initial turn on and when readjustment is performed as temperature gradually increases.

The water conservator system and method according to principles of the present invention provides plumbing arrangements to facilitate saving of water during adjustment of flow and temperature and precludes the need for shut-off and repeat adjustment while saving, for reuse, the water that otherwise flows unused to drain. Accordingly, one of the objects of the invention is the provision of water outlet fixtures having diverter valving means to selectively divert water flow through return conduits to storage means, whence it is returned to the water supply for reuse, so that water adjustment may be performed with least waste and water flow may be left turned on (and adjusted) without it being wasted to drain when actual use is temporarily suspended.

SUMMARY OF THE INVENTION

In accordance with principles of the present invention, a water supply plumbing system is provided with outlet fixtures having diverter valving means arranged at outlets for selective diversion of water flow through return conduits to storage means. Storage means include level sensing means and pressurization means to provide for return delivery of stored water into the normal water supply plumbing in dependence upon the water level in storage means. Backflow preventer valving is disposed in the return piping leading from fixtures to storage means and in piping from storage means to the normal water supply plumbing. The water main connection to the normal water supply plumbing is provided with another backflow preventer (or check valve) upstream from its joint with the storage means outlet piping.

In use of the system, when a water outlet fixture is turned on and is adjusted, its diverter valving provides for diversion of water via return conduits to the storage means. Once turn-on and adjustment has been accomplished, the diverter valving can be selectively switched to normal outlet flow or to return flow to the storage means. Thusly, at least a major portion of the water volume flowing through a fixture in the course of turning on and adjusting of the fixture is diverted to the storage means for reuse. Additionally, as water from the fixture is used, the diverter valving can be selectively switched to return flow to the storage means during a suspension of actual water use without affecting the preadjusted flow rate and water temperature, while saving the flowing water volume in the storage means for reuse and precluding the need for readjustment when actual water use is resumed by switching the diverter valving accordingly.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
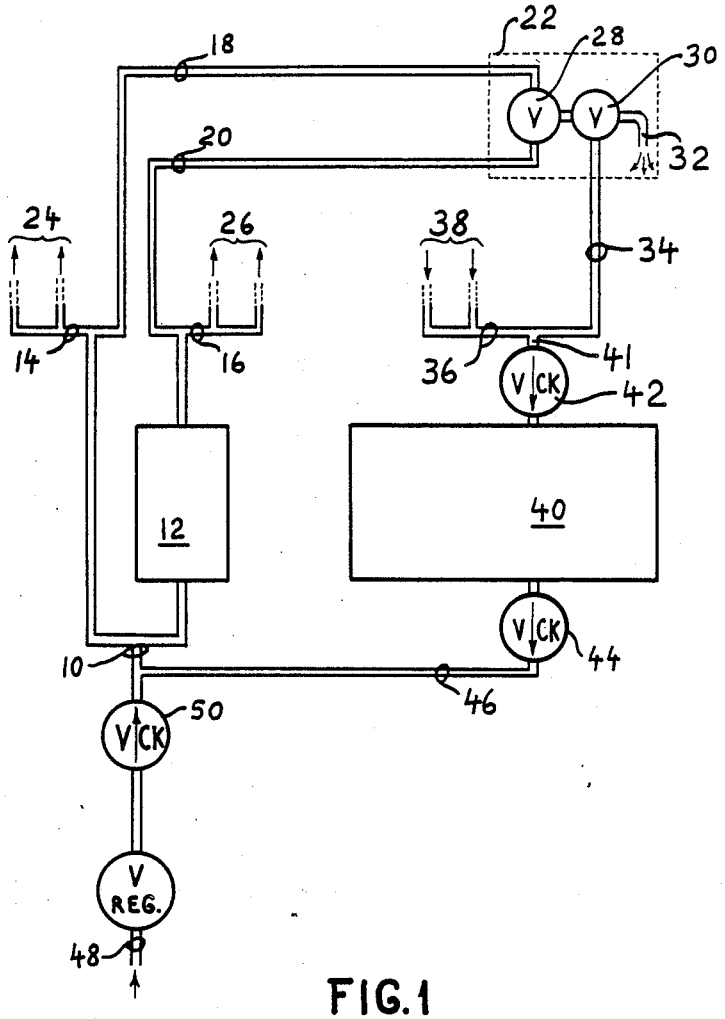
FIG. 1 is a schematic diagram of a plumbing system according to the invention.

Referring to FIG. 1, the schematic diagram shown therein includes a portion of a customary cold and hot water plumbing system comprising a common supply conduit 10 that feeds a hot water heater 12 and, in parallel therewith, a cold water distribution system 14. Hot water heater 12 feeds a hot water distribution system 16. As is customary in water plumbing installations, most water use fixtures are supplied through a cold and a hot water conduit with cold and hot water. An example of such a conduit arrangement is shown by cold water conduit 18 and hot water conduit 20. These conduits are shown to lead to a fixture 22 (dotted outline). Other cold and hot water conduits 24 and 26, respectively, are indicated here and they lead to other here not shown fixtures.

According to principles of the present invention, fixture 22 comprises not only conventional valving for turning water on and off and for adjusting of temperature and volume flow, here indicated by mixer valving 28, but further comprises a diverter valve 30. It will be understood that mixer valving 28 can be a single mixing valve or individual valves, one each for turn on and adjustment of the cold and the hot water. The adjusted flow output from mixer valving 28 is fed to diverter valve 30, wherein it is selectively diverted either to fixture outlet 32 or to return conduit 34. Return conduit 34 leads to a return manifold 36. Other fixtures, similarly equipped with diverter valves (as in shown fixture 22), have other return conduits 38 lead to return manifold 36. Return manifold 36 is connected to storage means 40 via connection 41. Storage means 40 comprises backflow preventer means or a check valve 42 so that water flow is permitted only from return manifold 36 to storage means 40. Storage means 40 further comprises another backflow preventer means or a check valve 44 in an outlet conduit 46 to permit flow only in a direction from storage means 40 to outlet conduit 46. Outlet conduit 46 is a feed conduit that feeds common supply conduit 10.

Check valves employed in the plumbing system of the invention can be of conventional types readily available on the market from a number of sources. For example, suitable check valves/back flow preventers are obtainable under the name "Watts Check Valve and Backflow Preventer" from VAMAC, Rt. 114 and Chestnut St., No. Andover, Mass. 01845.

According to principles of the invention, common supply conduit 10 is fed water from water main 48 through a check valve 50 (backflow preventer). A pressure reducer/regulator 51 can be provided between water main 48 and check valve 50 in plumbing system installations that are supplied from water main 48 with water pressures that substantially exceed the customary pressures employed in the particular plumbing system.

Figure 2:
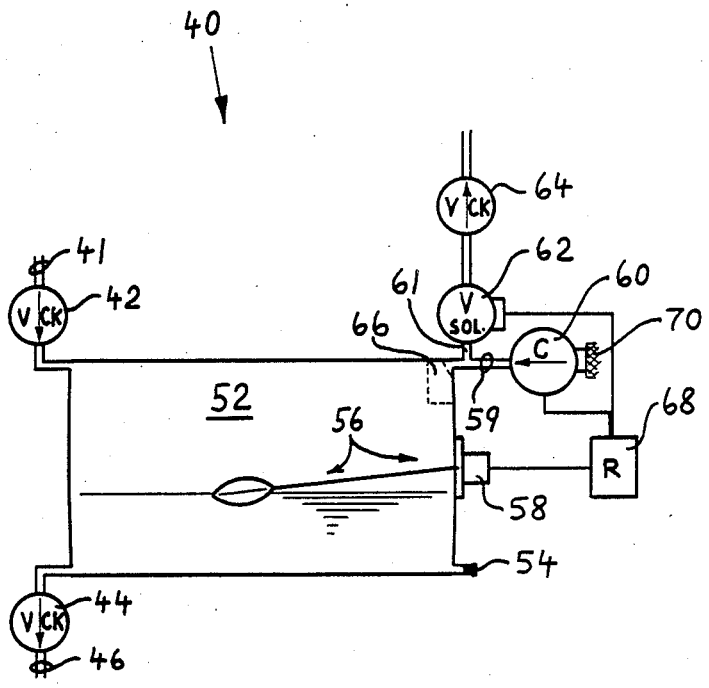
FIG. 2 is a schematic diagram of the storage means indicated in FIG. 1, and showing additional detail.

Referring now to FIG. 2 (in conjunction with FIG. 1), storage means 40 is shown herein in more detail. Storage means 40 comprises a tank 52 for temporary storage of water fed thereto from connection 41 via check valve 42. Tank 52 includes a drain 54 that is shown closed and that serves for flushing and draining of tank 52 when needed. Tank 52 further includes level sensing means 56, for instance as indicated, in form of a float that actuates electrical switches in sensor unit 58 to provide electrical signals corresponding to various water levels in tank 52. Additionally, tank 52 includes in an uppermost region a pressurization connection 59 from pressurization means, for instance in form of a compressed air source 60, and further includes a venting connection 61 leading via vent valve means 62 to ambient atmosphere. An air check valve 64 can be included in venting connection 61, as indicated here, for purposes of avoiding dirt entering thereinto. An air filter (not shown here) can be provided, alternately or in addition, for the same purpose.

An optional water stop means 66 can be disposed within tank 52 or within the connection leading to venting connection 61 and pressurization connection 59 to automatically close off this connection to water in case of a malfunction. For instance, if electrical power or level sensing means 56 fails and water fills tank 52 to the top, water stop means prevents water from entering the connections to vent valve means 62 and to compressed air source 60. Water stop means 66 can be of a conventional design based on a float closing a valve orifice when the float is lifted by liquid level. However, air flow in any direction by itself does not caused orifice closure. Moreover, compressed air entering from compressed air source 60 overrides orifice closure and can pressurize tank 52.

Storage means 40 further comprises relay means 68 in electrical connection with and controlled by sensor unit 58. Relay means 68, in turn, is in electrical connection with and controls compressed air source 60 and vent valve means 62. Vent valve means 62 is electrically actuatable to open and close, and can be a conventional solenoid air valve or a conventional motorized air valve. Compressed air source 60 is electrically actuatable, and is provided preferably in form of a small air compressor including an inlet filter 70, as indicated here. Compressed air source 60 may be alternately provided by a compressed air supply that is replenished in conventional manner and that is valved to pressurization connection 59 by, for instance, a solenoid valve under control from relay means 68.

Control of compressed air source 60 and vent valve means 62 is performed by relay means 68 substantially in such a manner that, while compressed air source 60 pressurizes tank 52, vent valve means 62 is closed, and, while compressed air source 60 is inactive or disconnected from pressurization connection 59, vent valve means 62 is opened to vent the tank 52. It will be appreciated that, if an air compressor is employed that is not of the positive displacement type, its outlet needs to be provided with a check valve to stop backflow into the compressor when the compressor is not operating.

Figure 2A:
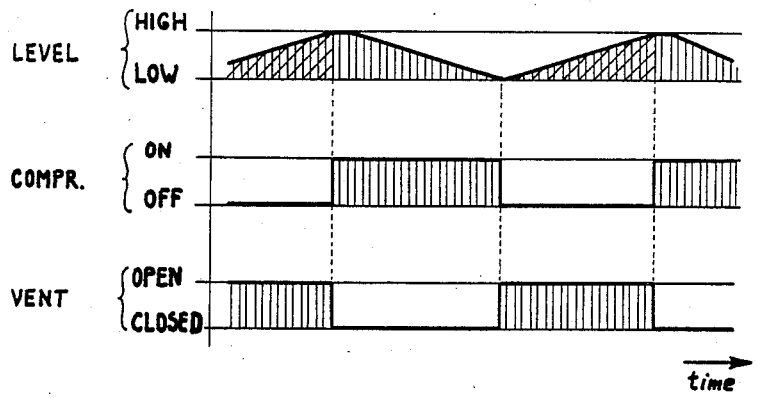
FIG. 2A is a schematic timing diagram of level changes and other occurrences in storage means shown in FIG. 2.

Operation of the system depicted in FIGS. 1 and 2 will now be described in conjunction with FIG. 2A. When fixture 22 (or any other similar fixture) is turned on by mixer valving 28, either outflow from fixture outlet 32 results or the water flows into return conduit 34, depending on the selectively adjusted position of diverter valve 30. Water flowing into return conduit 34 continues to flow through return manifold 36 to connection 41, through check valve 42 into tank 52 and is stored therein as a stored flow. This situation is schematically indicated in FIG. 2A at the left hand beginning of the shown graphs.

The level of the stored flow in tank 52 increases from a low value toward a high value, the tank being filled with air approximately at atmosperic pressure above the water level. At this time, compressed air source 60 is off and the tank is vented to ambient atmosphere via open vent valve means 62, as further indicated in FIG. 2A. The water level indicated in FIG. 2 approximately corresponds to this shown situation (at the left beginning side of the graphs in FIG. 2A). Also at this time, check valve 44 is closed, because the pressure in common supply conduit 10 (and therewith also in outlet conduit 46) is at a normal water supply pressure level, whereas the pressure in tank 52 (tank is vented to atmosphere) upstream from check valve 44 corresponds only to the depth of water in the tank.

Assuming that water continues to flow from fixture 22 or from any other fixture or fixtures via return manifold 36 into tank 52, the water level in tank 52 will reach a high level that is sensed by level sensing means 56. Relay means 68 is thereby set to turn on compressed air source 60 to feed compressed air into tank 52 and to thereby pressurize the water contained therein. At the same time, relay means 68 is also set to close vent valve means 62. Tank 52 is pressurized to a pressure somewhat exceeding the pressure in outlet conduit 46 and in common supply conduit 10, so that check valve 44 opens and passes water through into outlet conduit 46 and into common supply conduit 10 upon water demand. Pressurization of tank 52 also closes check valve 42, so that compressed air is prevented from entering return manifold 36 and water cannot pass therefrom into tank 52. Check valve 50 is now closed as a consequence of the somewhat increased pressure in common supply conduit 10, which pressure exceeds the pressure provided by water main 48 (or the downstream pressure produced by pressure reducer/regulator 51, if present).

Continuing or subsequent use of water from a fixture results in feed of pressurized water from tank 52 into common supply conduit 10 and, thusly, in reuse of water stored in storage means 40. Tank 52 empties and, when the water level therein reaches a low level, level sensing means 56 resets relay means 68 which in turn shuts off tank pressurization by compressed air source 60 and opens vent valve means 62. Consequently, tank 52 is again in condition to receive water from return manifold 30, as hereinabove described. As indicated by cross-hatched portions under the upper graph of FIG. 2A (indicating level), water is saved during each filling cycle of tank 52.

It will be appreciated that vent valve means 62 and pressurization means (compressed air source 60) are controlled means. These controlled means are controlled by relay means 68 in correspondence with and in response to sensing of particular levels of stored flow in storage means 40. These controlled means engender operating conditions in storage means 40, which operating conditions include receiving return flow from fixtures and storing and delivering this flow, on demand, to common supply conduit 10, as hereinbefore described. Consequently, the operation of the system is governed by these controlled means in conjunction with level sensing means 56 and relay means 68.

Fixture 22 represents any fixture provided with a diverter valve as indicated by diverter valve 30 and associated return conduit 34 (or 38). For instance, sink, wash-basin, bath faucets, and shower fixtures provided with appropriate diverter valves and with associated return conduits, connected as described herein, allow conserving of water. In a preferable use of such fixtures, the diverter valve is preset to divert flow to the respective return conduit and thereby to storage means 40 while water is turned on and adjusted with respect to volume and temperature and for the time it takes for warm water to substantially settle to a constant temperature. Brief switch-over of the diverter valve to permit flow from the fixture's outlet can check this condition. However, generally people are accustomed to approximately judging the time it takes and need not check this condition. In any case, clean water is conserved during this time, rather than running off unused to drain.

Diverter valve 30 (indicated in FIG. 1) provides for selective diversion of water flow (fed thereto) to fixture outlet 32 or to return conduit 34, as hereinabove described. Whereas diverter valve 30 is manually switchable at any time between these two states (diverter valve 30 being basically bistable), it will be understood that water saving will be particularly promoted if it is assured that diverter valve 30 is in the state of flow diversion to return conduit 34 prior to water being turned on by mixer valving 28. Therefore, one embodiment of diverter valve 30 provides for a mechanically biased mechanism therefor, so that diverter valve 30 switches automatically to a preferential state to divert to return conduit 34 upon cessation of water flow to diverter valve 30 (for instance by water being turned off by mixer valving 28). However, the opposite state can be chosen to be the preferential state, as this can be more convenient in some particular installations. A preferential state can be achieved, for example, by spring-loading the mechanism of diverter valve 30 to the respective preferential position by a spring force that is adequate to move the mechanism to such state in absence of water flow (and pressure), yet wherein this spring force is insignificant in comparison with the forces acting upon the mechanism when water flow therethrough is present. Consequently, such a biased diverter valve will be manually selectively switchable to and will remain in either state (i.e. will be bistable) during water flow therethrough, but will move to the preferential divert state, for instance to return conduit 34 upon cessation of flow to the diverter valve. Alternately other mechanism biasing means can be applied. For example, gravity effects may be utilized to force the diverter mechanism to fall into the return conduit diversion state in absence of water flow. The latter effect has been customarily used in many bath tub fixtures for diverting from shower to faucet, the preferential state of diversion to faucet being attained upon cessation of flow to shower. Diverter valve 30, having such a preferential action, will be termed hereinafter a preferential diverter valve.

Another very significant opportunity for conserving water is offered in many tasks wherein water is used intermittently, while it is left to run continuously. For instance, during soaping, shampooing, brushing of teeth, shaving, etc. most people leave water running continuously, even though the water is actually used only for proportionately very short times; one of the reasons being that intermittent rinsing and other uses require the previously preadjusted volume flow rate and temperature. Readjustment, had water been turned off during such temporary non-use periods, is inconvenient and time consuming and, in any case does not necessarily save water, since any water saving is likely to be more than offset by the water flowing unused to drain during readjustment.

By use of the water conservator system of the invention in such situations, preadjusted water can be temporarily selectively diverted to storage means for reuse without substantially affecting prior adjustment of volume and temperature. Thusly the inconvenience and inefficiency hitherto associated with temporary water shut-off and subsequent readjustment are reduced, if not removed entirely.

It will be recognized that the particular storage means 40 depicted in FIG. 2 is unavailable for storing return flow during the time when tank 52 is pressurized and empties to common supply conduit 10. Nonetheless, significant water conservation is achieved, albeit not all the conservation that can be accomplished. As in most engineering endeavors, a trade-off between cost, benefit, and preparedness of a buyer to expend respective funds has to be balanced. Whereas the system including the particular storage means 40 depicted in FIG. 2 cycles, as indicated, and thereby saves water in discontinous manner, it features relatively low complexity and low cost. In order to provide continuous water saving features according to principles of the invention, further embodiments are described hereinbelow in conjunction with FIGS. 3 and 3A, and in conjunction with FIGS. 4 and 4A.

Figure 3:
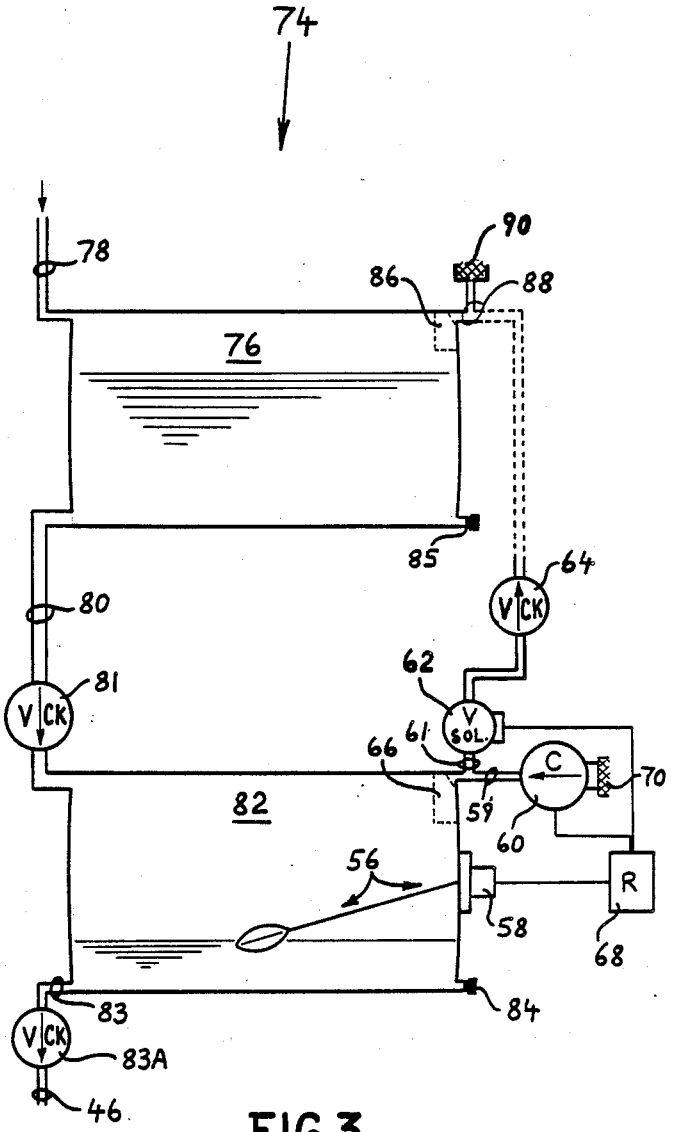
FIG. 3 is a schematic diagram of alternate storage means.

Referring now particularly to FIG. 3, a storage means 74 depicted therein is intended as an alternate embodiment to replace storage means 40 (of FIG. 2) in the plumbing system shown in FIG. 1. Storage means 74 comprises an auxiliary tank 76 that is connected to and fed by manifold 36 (FIG. 1) via a conduit 78. Storage means 74 further comprises a gravity conduit 80 and a main tank 82. Gravity conduit 80 connects a lowermost region of auxiliary tank 76 to main tank 82 through a check valve 81. Auxiliary tank 76 is disposed at a height substantially above main tank 82, so that water can flow from the former to the latter by the effect of gravity. Main tank 82 is provided with an outlet 83 and a drain 84 in a lowermost region of the tank. Auxiliary tank 76 is also provided with a drain 85. Drains 84 and 85 are normally closed off and are used only for flushing out and draining of the tanks when needed. Gravity conduit 80 is preferably of a relatively large size to facilitate flow rates therethrough (under influence of gravity alone) that are comparable to other system flow rates (due to system pressures).

Main tank 82 substantially comprises components similar or identical to the components comprised in storage means 40 shown in FIG. 2, which components function substantially in similar manner, as hereinbefore described. Thus main tank 82 comprises level sensing means 56 including sensor unit 58, pressurization connection 59, compressed air source 60, venting connection 61, and vent valve means 62. Air check valve 64 can be also included in venting connection 61 or, alternately or in addition thereto, an air filter (not shown here) can be provided at the downstream outlet of check valve 64. Optional water stop means 66 can be provided. Further comprised in main tank 82 is relay means 68 for control of compressed air source 60 and of vent valve means 62 in dependence upon electrical signals received from level sensing means 56 (also as in FIG. 2). Inlet filter 70 is provided at the air inlet side of compressed air source 60. Outlet 83 from main tank 82 leads via a check valve 83A to outlet conduit 46.

Auxiliary tank 76 can further comprise optional water stop means 86 which is substantially identical to water stop means 66 (FIG. 2) and serves the same purpose; here with respect to a vent connection 88. Vent connection 88 connects an uppermost region of auxiliary tank 76 to atmosphere. Vent connection 88 can be provided with a dirt filter 90 to prevent ingestion of dirt into auxiliary tank 76. As both main tank 82 and auxiliary tank 76 are vented to atmosphere, albeit in different functional manner, the outlet of air check valve 64 can be connected to vent connection 88 to thereby lead to a common opening to ambient atmosphere; for instance via indicated dirt filter 90. This optional installation arrangement is indicated in dotted lines by a common connection 92.

Figure 3A:
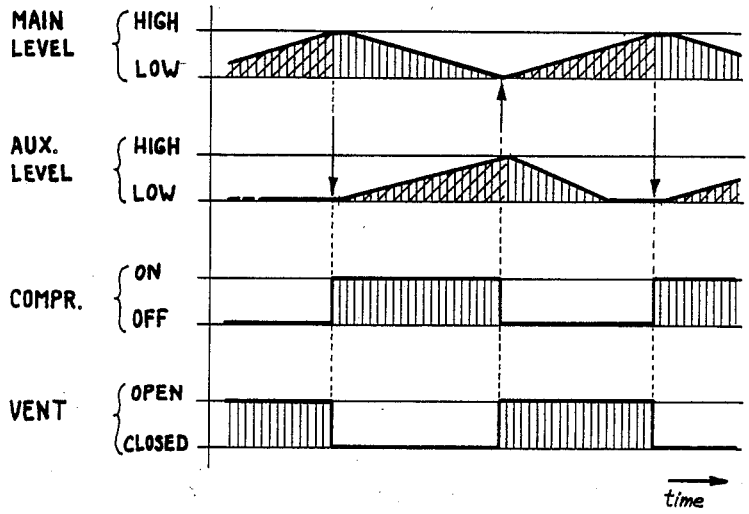
FIG. 3A is a schematic timing diagram of level changes and and their interdependence and other occurrences in storage means of FIG. 3.

Operation of the system depicted in FIG. 1 including storage means 74 (of FIG. 3) in place of storage means 40 will now be described in view of FIG. 1 in conjunction with FIGS. 3 and 3A. When fixture 22 (or any other similar fixture) is turned on by mixer valving 28, either outflow from fixture outlet 32 results or the water flows into return conduit 34, depending on the selectively adjusted position of diverter valve 30. Water flowing into return conduit 34 continues to flow through return manifold 36 and therefrom via conduit 78 into auxiliary tank 76.

Provided that main tank 82 is not filled to a high level or is not being pressurized and emptied at this time, water continues to flow from auxiliary tank 76 into main tank 82 through gravity conduit 80 via check valve 81. This situation is schematically indicated in FIG. 3A at the left hand beginning of the shown graphs.

The water level in main tank 82 rises from a low value toward a high value, the tank being filled above the water level with air approximately at atmosperic pressure. At this time, compressed air source 60 is off and the tank is vented to ambient atmosphere via open vent valve means 62, as further indicated in FIG. 3A. The water level indicated only in main tank 82 in FIG. 3 approximately corresponds to this shown situation (at the left beginning side of the graphs in FIG. 3A). Also at this time, check valve 83A is closed, because the pressure in common supply conduit 10 (and therewith also in outlet conduit 46) is at a normal water supply pressure level, whereas the pressure in main tank 82 (tank is vented to atmosphere) upstream from check valve 83A corresponds only to the depth of water in the tank.

Assuming that water continues to flow from fixture 22 or from any other fixture or fixtures via return manifold 36 through conduit 78 into auxiliary tank 76, and therefrom through gravity conduit 80 via check valve 81 into main tank 82, the water level in tank 82 will eventually reach a high level that is sensed by level sensing means 56. Relay means 68 is thereby set to turn on compressed air source 60 to feed compressed air into main tank 82 and to thereby pressurize the water contained therein. At the same time, relay means 68 is also set to close vent valve means 62. Main tank 82 is pressurized to a pressure somewhat exceeding the pressure in outlet conduit 46 and in common supply conduit 10, so that check valve 83A opens and passes water through into outlet conduit 46 and into common supply conduit 10 upon continuing water demand.

Pressurization of main tank 82 also closes check valve 81, so that compressed air is prevented from entering auxiliary tank 76 and water cannot pass therefrom into main tank 82. Check valve 50 (FIG. 1) is now closed as a consequence of the somewhat increased pressure in common supply conduit 10, which pressure exceeds the pressure provided by water main 48 (or the downstream pressure produced by pressure reducer/regulator 51, if present). Closure of check valve 81 results now in filling of auxiliary tank 76 by water flowing from return manifold 36 (provided that water flow is diverted to a return conduit in any of the fixtures of the system). This situation is schematically represented in FIG. 3A at the time when main (tank) level decreases and auxiliary level rises and it is approximately also shown by the depicted water levels in the two tanks in FIG. 3.

Continuing or subsequent use of water from a fixture results in feed of pressurized water from main tank 82 into common supply conduit 10 and thusly in reuse of water stored in storage means 74. Main tank 82 empties and when the water level therein eventually reaches a low level, level sensing means 56 resets relay means 68 which in turn shuts off tank pressurization by compressed air source 60 and opens vent valve means 62. Consequently, main tank 82 is again in condition to receive water from auxiliary tank 76 and therethrough from return manifold 30, as hereinabove described. As indicated by cross-hatched portions under the two upper graphs of FIG. 3A (indicating tank levels), water is permitted to flow continuously from return manifold 36 into storage means 74 and is thereby conserved for reuse. Vertical arrows in FIG. 3A indicate the interdependent alternating filling cycles occurring for main tank 82 and auxiliary tank 76. As main tank 82 is filling, auxiliary tank drains thereinto and, as main tank 82 is emptying, auxiliary tank 76 is filling. It will be understood that the cyclical operation (and the timing thereof) of the tanks in storage means 74 is entirely automatically governed by the water demand and by the availability of recovered return water (and return water flow) in storage means 74.

Figure 4:
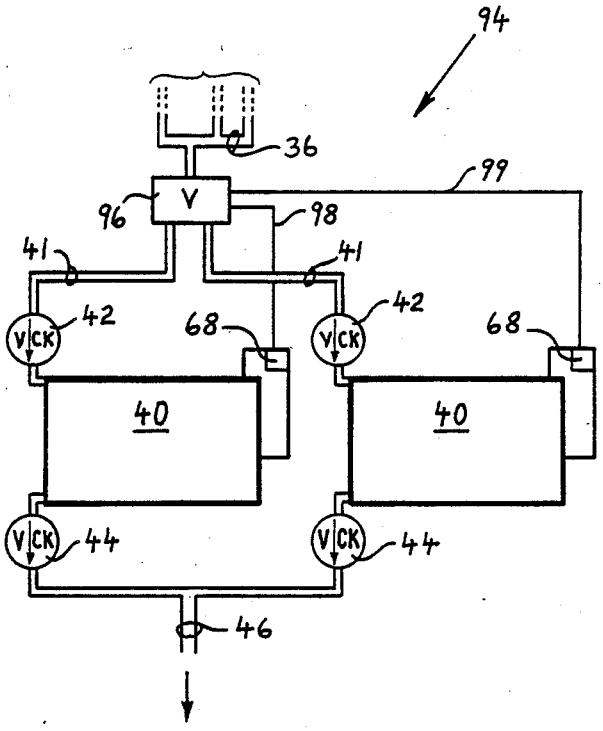
FIG. 4 is a schematic diagram of yet further alternate storage means.
Figure 4A:
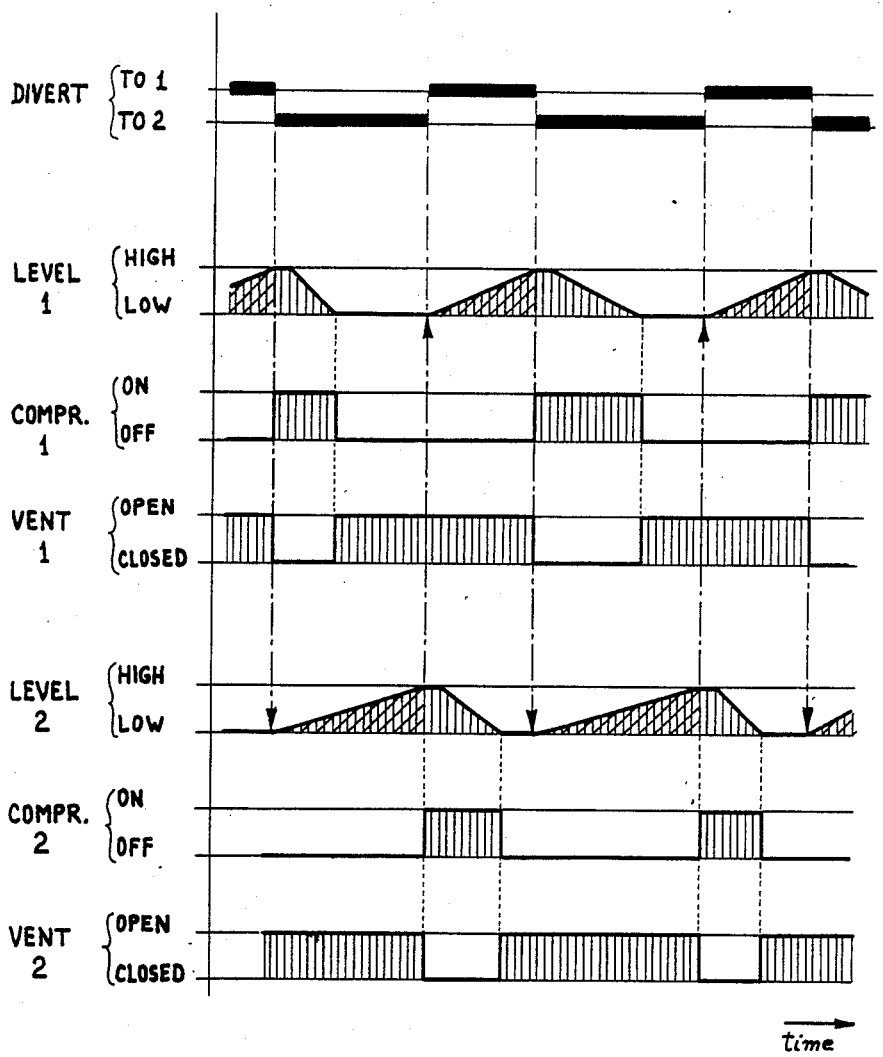
FIG. 4A is a schematic timing diagram of level changes and their interdependence and other occurrences in storage means of FIG. 4.

Referring now to FIG. 4, a storage means 94 depicted therein is intended as a further alternate embodiment to replace storage means 74 (of FIG. 3) or storage means 40 (of FIG. 2) in the plumbing system shown in FIG. 1. Storage means 94 comprises two identical storage means 40, each comprised of components substantially as hereinbefore described in conjunction with FIG. 2. The two storage means 40 are arranged in parallel so that their outlets feed via check valves 44 into outlet conduit 46 and thereby into common supply conduit 10 (FIG. 1). Each of the two inlet connections 41 feeds via a respective check valve 42 one of the two storage means 40. Return manifold 36 is connected to the inlet side of a distribution diverter valve 96 which is selectively operatable in accordance with electrical signals received from relay means 68, and which selectively diverts flow received from return manifold 36 to either one or the other connection 41 and thereby to either one or the other of storage means 40.

For purposes of this description, the storage means 40 depicted on the left side in FIG. 4 shall be termed first storage means and the storage means 40 depicted on the right side in FIG. 4 shall be termed second storage means. An electrical signal connection 98 leads from relay means 68 comprised in first storage means to distribution diverter valve 96. An electrical signal connection 99 leads from relay means 68 comprised in second storage means to distribution diverter valve 96. The electrical signals controlling selective diversion by distribution diverter valve 96 are substantially the same as the signals directing vent valve means 62 (FIG. 2) to close. The signal through electrical signal connection 98 causes distribution diverter valve 96 to divert flow to second storage means and the signal through electrical signal connection 99 causes distribution diverter valve 96 to divert flow to first storage means. Each of these signals is originated by the respective level sensing means 56 (FIG. 2) as it detects high water level. Thus as vent valve means 62 (of one storage means) closes, distribution diverter valve 96 is directed to divert to the other storage means, and vice-versa. This alternating operation is schematically diagrammed in FIG. 4A, wherein the uppermost graph shows the diversion state of distribution diverter valve 96 in relation to water levels and compression (pressurization) and venting occurrences in first and second storage means, respectively. Numerals 1 and 2 associated with particular legends in FIG. 4A refer to correspondence thereof with first and second storage means, respectively.

Each of the storage means 40 (of FIG. 4) individually operates substantially as hereinbefore described in conjunction with FIGS. 2 and 2A, albeit in alternating interdependence automatically governed by the hereinabove described alternating diversion by distribution diverter valve 96. Cross-hatched portions in the LEVEL 1 and LEVEL 2 graphs in FIG. 4A indicate the alternating filling of first and second storage means, respectively, and thusly show the continuous flow capability of storage means 94. Vertical arrows in FIG. 4A indicate the interdependence between alternating filling cycles occurring in first and second storage means of storage means 94. Cyclical operation (and the timing thereof) in storage means 94 is entirely automatically governed by the water demand and by the availability of recovered return water in storage means 94. When no recovered water is available, any demand is filled by the water supply from the water main 48 (FIG. 1). It will be understood that water is permitted to flow substantially continuously from return manifold 36 into storage means 94 and is therein conserved for reuse.

Figure 5:
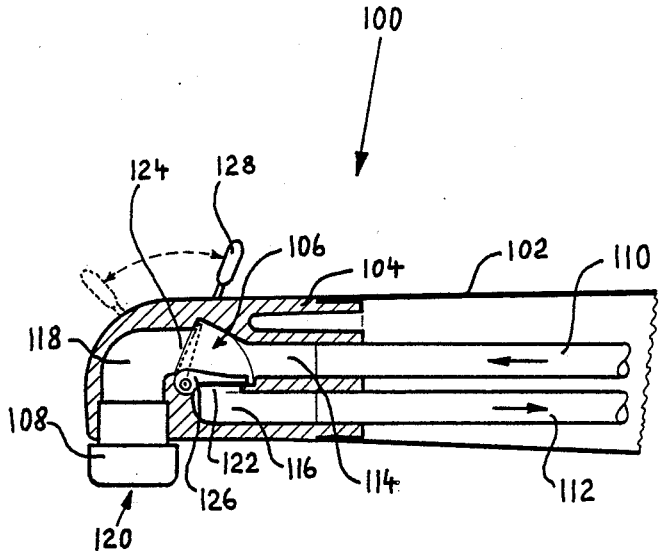
FIG. 5 is a schematic partially fragmental and sectional view of a sink or bathroom faucet fixture for use in a system according to the invention.

Referring now to FIG. 5, a portion of a faucet fixture 100 according to principles of the present invention is depicted therein. Faucet fixture 100 is representative of fixtures comprised in a plumbing system of the invention shown in FIG. 1, and can, for instance, represent fixture 22 (FIG. 1). Faucet fixture 100 comprises customary mixer valving, mounting means, escutcheons, and other conventionally employed components. As shown in FIG. 5, faucet fixture 100 comprises further a housing 102, an outlet body 104 having a diverter valve 106 disposed therein, a conditioner 108, an inlet conduit 110, and a return conduit 112.

Outlet body 104 includes an inlet duct 114 for receiving water from mixer valving (for instance, mixer valving 28 in FIG. 1) through inlet conduit 110, a return duct 116 for returning water for recovery to storage means (for instance, storage means 40 in FIG. 1), and an outlet duct 118 for delivering water to a fixture outlet 120 (for instance, fixture outlet 32 in FIG. 1) through conditioner 108. Conditioner 108 customarily serves to provide non-splash water flow from fixture outlet 120, and customarily often comprises an aerator and/or other outflow conditioning means. Inlet conduit 110 is connected to inlet duct 114 and return conduit 112 is connected to return duct 116. A return opening 122 communicates between inlet duct 114 and return duct 116. An outflow opening 124 joins inlet duct 114 and outlet duct 118. Diverter valve 106 comprises a valve flap 126 that is pivotably disposed in the region of return opening 122 and outflow opening 124. Valve flap 126 is mechanically connected to a divert lever 128, so that selective manual rotation of divert lever 128 rotates valve flap 126 to selectively close off return opening 122 (as shown here) or outflow opening 124 (as indicated by dashed lines).

In one embodiment of the invention, the mechanism of diverter valve 106 is biased, for instance by spring-loading means, to automatically move into the position closing off outflow opening 124 in absence of water flow from inlet duct 114. During flow therethrough, however, diverter valve 106 is stable in either of the two positions shown due to water pressure/flow effects and/or by appropriate mechanical means that can be provided to cause such a positional bistability. Manual rotation of divert lever 128 overrides such pressure/-flow effects and/or mechanical means during water flow from inlet duct 114.

The description of the operation of outlet fixtures of the invention given hereinbefore in conjunction with fixture 22 and FIG. 1 is equally applicable to the operation of faucet fixture 100 of FIG. 5. In general though, water flow to faucet fixture 100 (of FIG. 5) will flow either into return duct 116 (and into return conduit 112) or into outlet duct 118 (and thereby out of fixture outlet 120), depending on the particular setting of diverter valve 106. Return flow into return conduit 112 is fed to storage means, as hereinbefore described, for recovery and reuse of such water.

Figure 6:
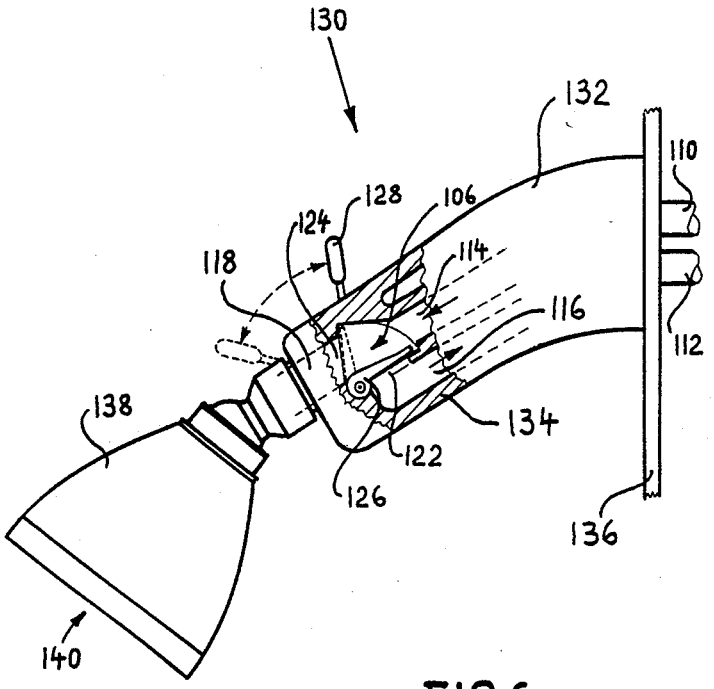
FIG. 6 is a schematic side view and partial section of a shower fixture for use in a system according to the invention.

Referring now to FIG. 6, a portion of a shower fixture 130 according to principles of the present invention is depicted therein. Shower fixture 130 is representative of fixtures comprised in a plumbing system of the invention shown in FIG. 1, and can, for instance, represent fixture 22 (FIG. 1). Shower fixture 100 comprises customary mixer valving, mounting means, escutcheons, and other conventionally employed components. As shown in FIG. 6, shower fixture 130 comprises further a housing 132, an outlet body 134 having diverter valve 106 disposed therein, a shower head 138, inlet conduit 110, and return conduit 112. Shower fixture 130 is shown here mounted upon a wall 136.

Outlet body 134 includes inlet duct 114 for receiving water from mixer valving (for instance, mixer valving 28 in FIG. 1) through inlet conduit 110, return duct 116 for returning water for recovery to storage means (for instance, storage means 40 in FIG. 1), and outlet duct 118 for delivering water to a fixture outlet (for instance, fixture outlet 32 in FIG. 1) which is represented here by shower head outlet 140. Inlet conduit 110 is connected to inlet duct 114 and return conduit 112 is connected to return duct 116. A return opening 122 communicates between inlet duct 114 and return duct 116. Outflow opening 124 joins inlet duct 114 and outlet duct 118. Diverter valve 106 comprises valve flap 126 that is pivotably disposed in the region of return opening 122 and outflow opening 124. Valve flap 126 is mechanically connected to a divert lever 128, so that selective manual rotation of divert lever 128 rotates valve flap 126 to selectively close off return opening 122 (as shown here) or outflow opening 124 (as indicated by dashed lines). Diverter valve 106 of FIG. 6 is substantially identical to diverter valve 106 of FIG. 5.

In one embodiment of the invention, the mechanism of diverter valve 106 is biased, for instance by spring-loading means, to automatically move into the position closing off outflow opening 124 in absence of water flow from inlet duct 114. During flow therethrough, however, diverter valve 106 is stable in either of the two positions shown due to water pressure/flow effects and/or by appropriate mechanical means that can be provided to cause such a positional bistability. Manual rotation of divert lever 128 overrides such pressure/-flow effects and/or mechanical means during water flow from inlet duct 114.

Other diverter valves than those shown as diverter valves 106 can be used. For instance, a commercially available diverter valve which can be readily adapted particularly for employment in shower fixtures is obtainable under the name "Push-Pull Dual-Diverter Valve, Alsons No. 4923" from the Alsons Corporation, Hillsdale, Mich. 49242, and Covina, Calif. 91723.

The description of the operation of outlet fixtures of the invention given hereinbefore in conjunction with fixture 22 and FIG. 1 is equally applicable to the operation of shower fixture 130 of FIG. 6. In general though, water flow to shower fixture 130 (of FIG. 6) will flow either into return duct 116 (and into return conduit 112) or into outlet duct 118 (and thereby through shower head 138), depending on the particular setting of diverter valve 106. Return flow into return conduit 112 is fed to storage means, as hereinbefore described, for recovery and reuse of such water.

Figure 7:
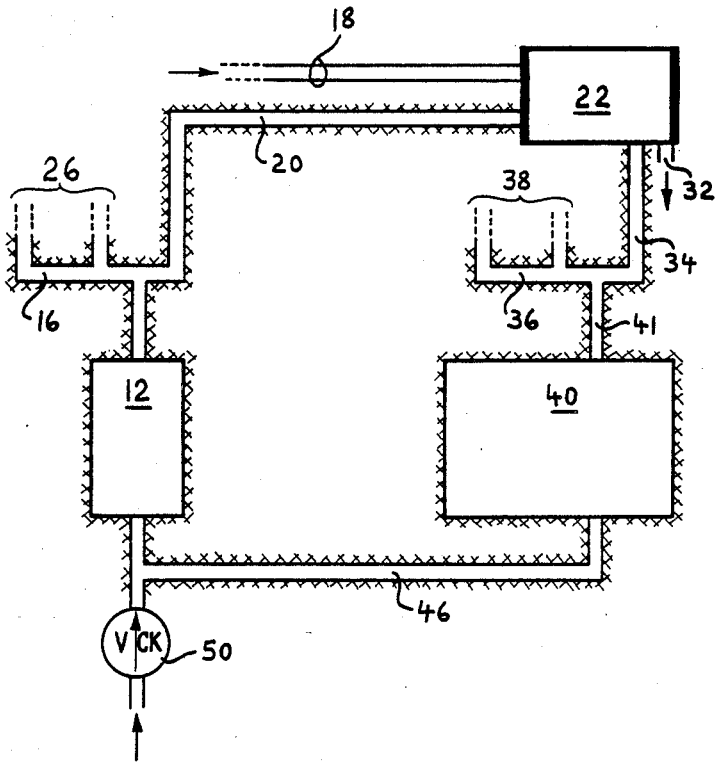
FIG. 7 is a schematic diagram of a plumbing system according to a further embodiment of the invention.

Referring now to FIG. 7, a plumbing system is shown here to illustrate another embodiment of the invention which is not only suited for conservation of water, but which is also particularly advantageous for conservation of hot water and thusly for saving of heating energy. The plumbing system shown in FIG. 7 is substantially identical to a portion of the system depicted in FIG. 1, except that outlet conduit 46 feeds into the conduit between check valve 50 and hot water heater 12 without also feeding the cold water distribution system. The cold water distribution system is not illustrated in FIG. 7, but it is fed directly from water main 48 (from a supply conduit location upstream from check valve 50). Moreover, components of the system shown in FIG. 7 that are liable to significant heat loss from the hot water circulated therein are provided with thermal insulation, as is indicated by cross-hatched component outlines.

Since the system depicted in FIG. 7 is otherwise identical to the system of FIG. 1, reference is made to the hereinbefore given descriptions. Of course, it should be understood that the system of FIG. 7 returns warm water from fixtures (such as fixture 22) through storage means 40 to hot water heater 12 only. It should be further understood that all descriptions given hereinbefore in conjunction with FIGS. 1 through 6 are substantially also applicable to the system of FIG. 7. For instance, storage means shown in FIGS. 3 and 4 can also be employed in place of storage means 40 of FIG. 7.

It will be recognized that the water conservator system of the invention can be readily adapted for recovery of drain or waste water from appliances, as for instance given by washing machines, dish-washing equipment, showers and baths, and the like, for appropriate reuse, for example in toilets as flushing water.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A water conservator system for plumbing installations comprising:

means to provide water flow from one or more fixtures in a water supply system to a return conduit as a return flow for water reuse;

storage means for providing operating conditions therein, said operating conditions providing for receiving said return flow and for storing said return flow as stored flow and for delivering said stored flow on demand through a feed conduit to said water supply system for reuse; and a first means for preventing backflow from said water supply system to a water main, said water main supplying water to said water supply system;

said storage means comprising:

second means for preventing backflow from said storage means to said return conduit;

third means for preventing backflow from said feed conduit to said storage means; and means for governing said receiving and said storing of said return flow and said delivering of said stored flow, said means for governing including:

controlled means to engender said operating conditions in said storage means;

level sensing means for sensing of high and low levels of said stored flow; and relay means for control of said controlled means in response to said high and said low levels being sensed by said level sensing means.

2. The water conservator system according to claim 1, wherein at least one fixture includes a fixture outlet, a diverter valve, and a return duct connecting to said return conduit, said diverter valve being fed water flow from said water supply system, said diverter valve being selectively operable to provide for selective diversion of said water flow to one of a first and a second flow path, said first flow path directing said water flow to said fixture outlet and said second flow path directing said water flow to said return duct.

3. The water conservator system of claim 2, wherein said diverter valve is manually selectively operatable.

4. The water conservator system of claim 3, wherein said diverter valve is bistable under the influence of said water flow.

5. The water conservator system of claim 3, wherein said diverter valve attains a preferential state in absence of said water flow, said preferential state diverting subsequent said water flow to a particular one of said first and second flow paths.

6. The water conservator system of claim 5, wherein said preferential state diverts said subsequent said water flow to said second flow path.

7. The water conservator system of claim 2, wherein said diverter valve is a flap valve having a pivotable flap for selective closing of said first or said second flow path.

8. The water conservator system according to claim 1, wherein said one or more fixtures includes at least one faucet fixture.

9. The water conservator system according to claim 1, wherein said at least one fixtures includes at least one shower fixture.

10. The water conservator system according to claim 1, said storage means comprising at least one storage tank.

11. The water conservator system according to claim 1, wherein said controlled means include vent valve means for selectively venting said storage means and, pressurization means for selectively pressurizing said storage means with air.

12. The water conservator system of claim 11, wherein said relay means actuates said vent valve means to an open state and actuates said pressurization means to a state disabling pressurization of said storage means in response to sensing of said low levels by said level sensing means, and wherein said relay means actuates said vent valve means to a closed state and actuates said pressurization means to a state enabling pressurization of said storage means in response to sensing of said high levels by said level sensing means.

13. The water conservator system according to claim 1, said storage means further comprising:

at least one auxiliary tank for receiving, intermittently storing, and intermittently passing on said return flow to a main tank.

14. The water conservator system according to claim 1, wherein said storage means includes a first and a second tank, said first and said second tank each being alternately cyclically provided with said operating conditions.

15. The water conservator system of claim 14, wherein said controlled means further include a distribution diverter valve for selectively diverting said return flow received from said one or more fixtures to said first tank in response to said level sensing means sensing a high level in said second tank, said distribution diverter valve selectively diverting said return flow received from said one or more fixtures to said second tank in response to said level sensing means sensing a high level in said first tank.

16. The water conservator system of claim 15, wherein said distribution diverter valve is electrically actuated by said relay means.

17. The water conservator system according to claim 1, wherein said water supply system is a hot water system, and wherein water conducting components comprised in said water conservator system are provided with thermal insulation to substantially reduce heat energy losses to ambient.

18. A water conservation method in plumbing installations, comprising the steps of:

(a) selectively returning water flow from one or more fixtures in a water supply system to a return conduit for reuse;

(b) receiving said water flow from said return conduit in storage means, said storage means providing operating conditions therein, said operating conditions providing for said receiving;

(c) storing said water flow as stored flow in said storage means, said operating conditions providing for said storing;

(d) delivering said stored flow on demand through a feed conduit to said water supply system for reuse, said operating conditions providing for said delivering;

(e) preventing backflow from said water supply system to a water main, said water main supplying water to said water supply system;

(f) preventing backflow from said storage means to said return conduit;

(g) preventing backflow from said feed conduit to said storage means;

(h) governing said operating conditions by controlled means to engender said operating conditions in said storage means;

(i) sensing of high and low levels of said stored flow; and (j) controlling by relay means said controlled means in response to said sensing of said high and said low levels.

* * * * *